US005715765A

United States Patent [19]

Ng

[11] Patent Number: 5,715,765

[45] Date of Patent: Feb. 10, 1998

[54] SEWING MACHINE HEM FOLDER ATTACHMENT

[76] Inventor: Siu Hong Ng, 1621 68th St., Brooklyn, N.Y. 11204

[21] Appl. No.: 794,579

[22] Filed: Feb. 3, 1997

Related U.S. Application Data

[63] Continuation of Ser. No. 617,150, Mar. 18, 1996, Pat. No. 5,598,798.

[51] Int. Cl.[6] ..... D05B 35/06

[52] U.S. Cl. ..... 112/141; 112/152; 112/324

[58] Field of Search ..... 112/52, 137, 141, 112/147, 139, 152, 323, 324, 260

[56] References Cited

U.S. PATENT DOCUMENTS

| | | | |
|---|---|---|---|
| 148,933 | 3/1874 | Comings | 112/137 |
| 1,560,219 | 11/1925 | Cunningham . | |
| 2,725,836 | 12/1955 | Gillium et al. | 112/324 X |
| 3,006,300 | 10/1961 | Stancel, Jr. . | |
| 3,334,603 | 8/1967 | Boser et al. | 112/152 |
| 3,600,220 | 8/1971 | Marforio . | |
| 4,817,544 | 4/1989 | Ackermann et al. . | |
| 4,901,657 | 2/1990 | Fieschi . | |
| 4,913,071 | 4/1990 | Kawasaki | 112/152 |
| 4,951,586 | 8/1990 | Becherini . | |
| 5,044,289 | 9/1991 | Keeton . | |
| 5,226,379 | 7/1993 | Everett . | |
| 5,598,798 | 2/1997 | Ng | 112/141 |

*Primary Examiner*—Ismael Izaguirre

*Attorney, Agent, or Firm*—Shlesinger Arkwright & Garvey LLP

[57] ABSTRACT

The present invention relates to a sewing machine attachment for sewing a length of hem material onto an edge of a workpiece comprising a hem folder, the hem folder configured for folding a strip of hem material and aligning the folded hem material with a needle of a sewing machine to facilitate the sewing thereof onto an edge of a fabric workpiece and a linkage mechanism connected to the hem folder for interconnecting the hem folder to a workpiece feeder of a sewing machine whereby movement of the workpiece feeder causes reciprocation of the hem folder and synchronous advancement of the hem material with the fabric workpiece. The present invention also relates to an automatic sewing machine provided with the sewing machine attachment.

20 Claims, 5 Drawing Sheets

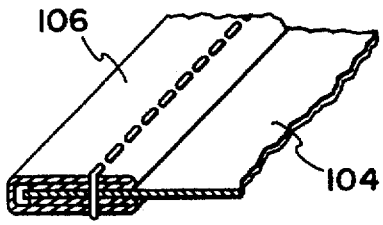
FIG. 10
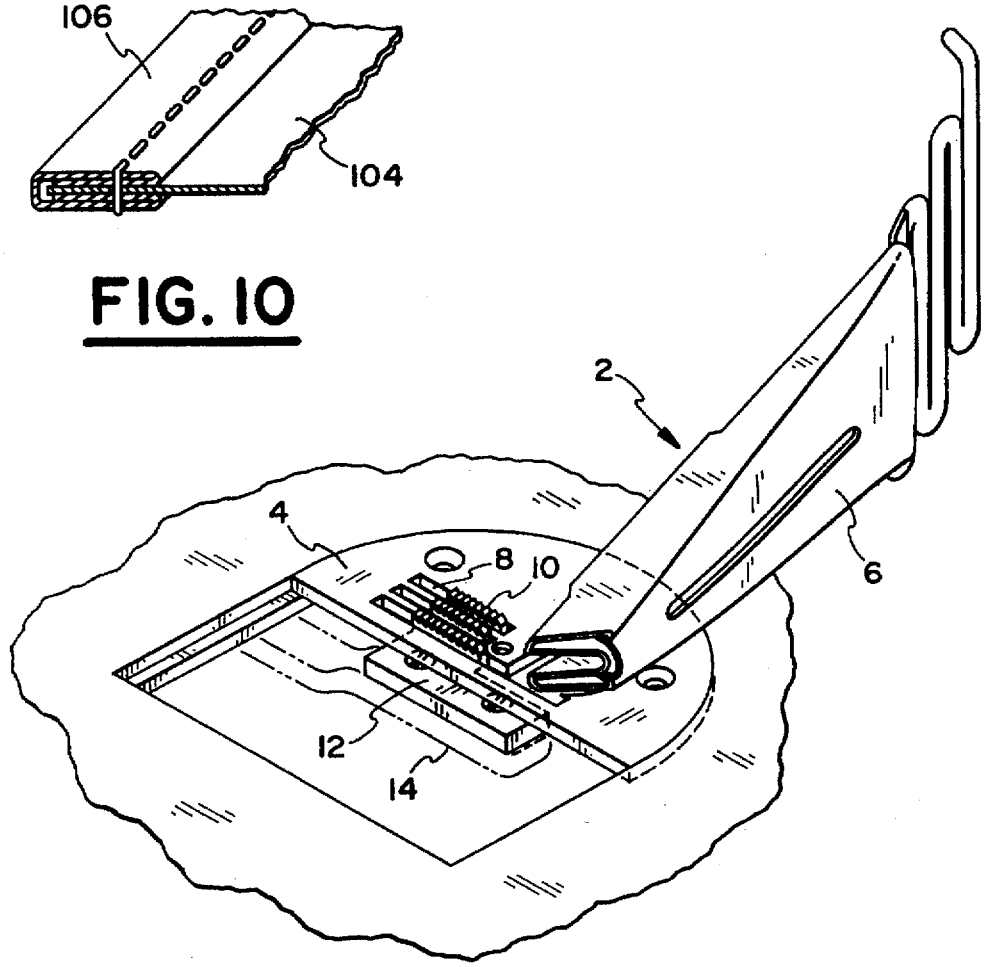
FIG. 1 - (Prior Art)
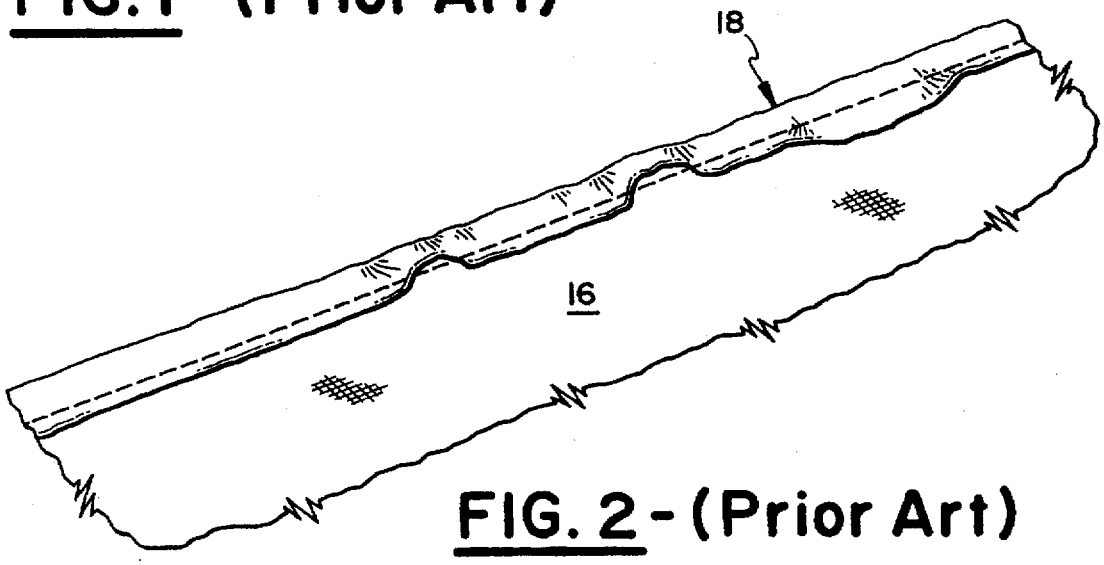
FIG. 2 - (Prior Art)

SEWING MACHINE HEM FOLDER ATTACHMENT

CROSS REFERENCE TO RELATED APPLICATION

This application is a continuation of U.S. Ser. No. 08/617,150 filed Mar. 18, 1996, now U.S. Pat. No. 5,598,798.

FIELD OF THE INVENTION

The present invention relates to an automatic sewing machine attachment for positioning a length of folded fabric onto the edge of a workpiece immediately prior to stitching.

BACKGROUND OF THE INVENTION

In the manufacture of fabric products such as clothing, it has long been the practice to sew the exposed edges of the fabric workpiece and render a neater appearance while also preventing fraying. In at least one type of operation, a separate, relatively narrow strip of fabric material is folded over the edge of the fabric workpiece and stitched in place to provide a hem.

Folding and alignment of the hem material has heretofore been accomplished by means of a folder attachment device. Prior art folder attachment devices generally comprise a fixed chute positioned adjacent the needle plate to render a continuous fold along the longitudinal axis of the hem material as it is conveyed through the chute.

These so called static folders have not been entirely satisfactory. A conventional sewing machine is designed to automatically advance a workpiece into position underneath the sewing needle by means of a reciprocating toothed device known as a feed dog or feeder. Because prior art folders operate independently of the reciprocating feeder, the hem fabric is not advanced with the workpiece. The result is uneven or bunched hemlines and a defective finished product.

Up to now, the only way to minimize these problems was to slow down the stitching operation and thereby ensure the careful alignment of the workpiece and folded hem prior to stiching. As is apparent, this approach raises labor costs and requires a highly skilled operator. Producing a neat hemline with static folders has therefore remained a vexing problems in the industry.

The present invention remedies the problems associated with the prior art by providing a dynamic folder attachment device adapted to reciprocate with the sewing machine feeder causing the hem material to advance in proper alignment with the workpiece prior to stiching.

OBJECTS AND SUMMARY OF THE INVENTION

It is therefore an object of the present invention to provide a folder attachment that will produce a uniform, neat and unbunched hem upon a workpiece.

Still another object of the present invention is to provide a dynamic folder attachment device adapted to reciprocate with the sewing machine feeder and therefore allow the hem material to advance in proper alignment with the moving workpiece.

Yet another object is to provide a folder attachment that is interconnected to the sewing machine feeder in a manner so as to synchronously advance the folded hem material with the fabric workpiece.

A further object of the present invention is to provide a sewing machine having the dynamic folder attachment according to the present invention.

Yet another object of the present invention is to provide a folder attachment that is readily incorporated within most conventional sewing machines easily and quickly.

Still further object of the present invention is to provide a method of sewing a hem onto a length of fabric workpiece in an efficient and neat manner.

In summary the present invention relates to a sewing machine attachment for sewing a length of hem material onto an edge of a workpiece comprising means for folding a strip of hem material and aligning the folded hem material with a needle of a sewing machine to enable the sewing of folded hem material onto the edge of a fabric workpiece and means for operably connecting the folding and aligning means with a workpiece feeder of a sewing machine, the connecting means is adapted to provide simultaneous reciprocation of the folding and aligning means with the workpiece feeder whereby movement of the workpiece by the feeder during a sewing operation will cause the strip of hem material to synchronosuly advance therewith and enable the hem material to be evenly sewn onto the fabric workpiece.

The present invention also relates at a automatic sewing machine adapted for sewing a length of hem material onto an edge of a fabric workpiece comprising a reciprocating needle for stiching a workpiece, a feeder guide including a reciprocating toothed member for conveying the workpiece into alignment the reciprocating needle, means for folding a strip of hem material and aligning the folded hem material with the needle to enable the sewing of folded hem material onto the edge of the fabric workpiece and means for operably connecting the folding and aligning means with the feeder guide, the connecting means adapted to provide simultaneous reciprocation of the folding and aligning means with the feeder guide whereby movement of the workpiece by the feeder guide during a sewing operation will cause the strip of hem material to synchronously advance therewith and enable the hem material to be evenly sewn onto the fabric workpiece.

These and other objects and advantages of the invention will become apparent from the following detailed description when read in connection with the accompanying drawings.

BRIEF DESCRIPTION OF THE DRAWINGS

FIG. 1 is a perspective view of a PRIOR ART folder attachment affixed to the needle plate of a sewing machine with portions of the sewing machine table shown broken away and the feed dog prime mover shown in phantom lines;

FIG. 2 illustrates a workpiece containing a hem sewn using a PRIOR ART folder attachment with portions of the workpiece shown broken away;

FIG. 10 is a hemmed fabric sewn with a folder attachment device according to the present invention and with portions of the hemmed fabric broken away.

DETAILED DESCRIPTION OF THE PREFERRED EMBODIMENT

Figure 3:
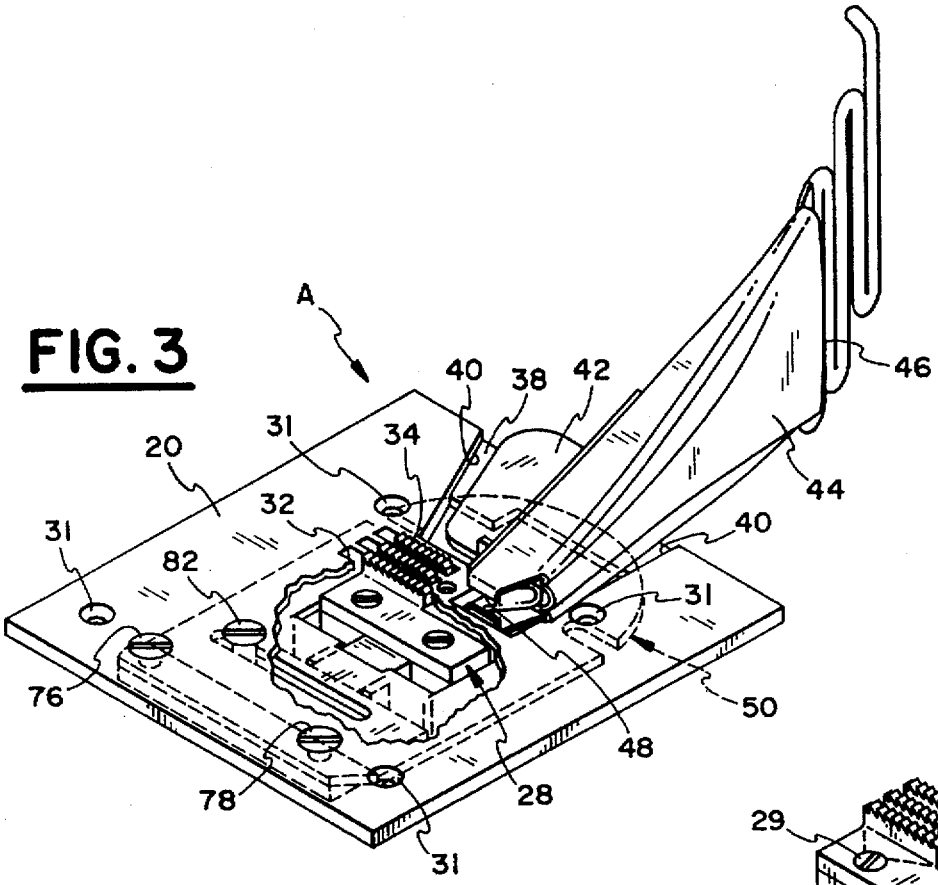
FIG. 3 is a perspective view of the folder attachment according to the present invention with portions of the needle plate shown broken away to expose the feeder connector.

Turning to FIG. 1, a PRIOR ART folder 2 is shown comprising a base or needle plate 4 having a static folder unit 6 secured thereto. As can be seen, the base plate 4 includes opening 8 adapted to receive the teeth 10 of the feeder or feed dog 12. A prime mover 14 of the sewing machine is secured to the feeder 12 to provide reciprocating movement of the feeder 12 within openings 8 of base plate 4. Because the folder unit 6 is immovably fixed to the base plate 4 and not interconnected to the prime mover, hem material (not shown) passing through the folder unit 6 will not be advanced towards the needle (not shown) at the same rate as the workpiece (not shown). The result is uneven pull of the hem material and bunching of the hem line. FIG. 2 best illustrates a workpiece 16 sewn by the PRIOR ART folder 2 and including a bunched and unevenly sewn hemline 18.

Figure 4:
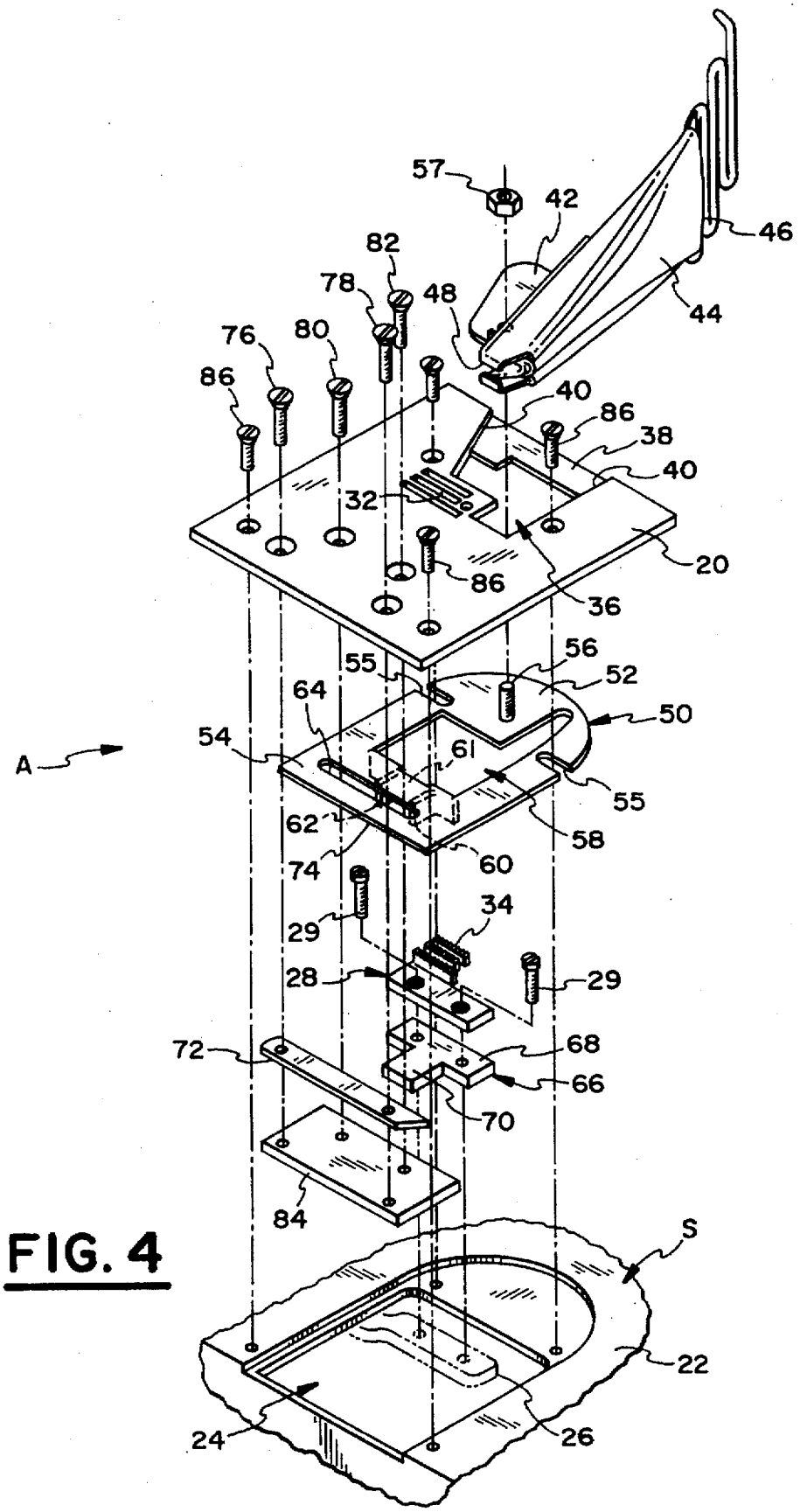
FIG. 4 is an exploded view of the folder attachment according to the present invention with portions of a sewing machine table shown broken away and the feeder prime mover shown in phantom lines.

Turning now to FIGS. 3 and 4, the folder attachment A according to the present invention is shown. The folder attachment A consist of a base member or needle plate 20 adapted to be secured to a sewing machine S in a known and conventional manner. As best shown in FIG. 4, the sewing machine S includes a housing or workpiece supporting table 22 having an opening 24 therein containing the prime mover 6. Screws 86 or other securing means extend through anchoring holes 31 and affix the needle plate 20 to the sewing machine table 22.

The needle plate 20 includes a series of parallel openings 32 through which extend the teeth 34 of feeder 28. A second opening 36 is provided adjacent openings 32 and includes a stepped portion 38 forming a pair of recessed abutments 40. The second opening 36 receives and pivotally supports on stepped portion 38 the base 42 of a folder attachment 44. The folder attachment 44 includes an opening 46 to receive the vertically disposed strip of hem fabric (not shown) form a bobbin or other storage device. As the strip of hem fabric advances through the folder attachment 44, it is caused to be folded along its longitudinal axis at least once to form a folded length of hem fabric continuously discharged through an exit portion 48 adjacent the feeder 28. Other folder designs are contemplated within the scope of the present invention.

A reciprocating plate 50 is provided on the underside of needle plate 20. The reciprocating plate 50 comprises a first end 52 and an opposite second end 54. The first end 52 is pivotally secured to the base member 42 of folder attachment 44 by a rivet 56 and nut 57. Other device securing devices are contemplated within the scope of the present invention so long as the folder 44 pivots in a plane substantially transverse to the base member 20. A central opening 58 extends through reciprocating plate 50 and between the first and second ends 52 and 54 to accommodate a feeder 28. A detent comprising a pair of opposed L-shaped flanges 60 and 62 are provided at second end 54 and adjacent opening 58. The flanges 60 and 62 form a channel 61 and extend transverse to reciprocation plate 50. Reciprocating plate 50 further includes a guide track 64 disposed at a second end 54.

Figure 5:
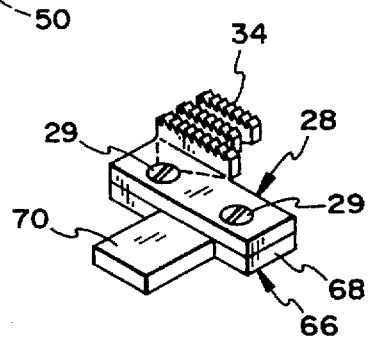
FIG. 5 is a perspective view of a feeder secured to the feeder connector according to the present invention.

A feeder connector 66 is provided and includes a base portion 68 and an extension portion 70 forming a generally T-shaped member. As best shown in FIG. 5, the base 68 of the feeder connector 66 is secured to feeder 28 by screws 29 or other device. In an alternative embodiment the feeder connector 66 may be formed integral with the feeder.

Returning now to FIGS. 3 and 4, a track member 72 is positioned against the edge 74 of reciprocating plate 50 and is fixedly secured to the underside of base 20 by track plate 84 with screws 76 and 78 or other fasteners. A second set of screws or fasteners 80 and 82 secure track plate 84 in place but also extend through guide track 64 of reciprocating plate 50. As is apparent, the fasteners 80 and 82 also function as stop limiters for movement of reciprocating plate 50 as will be further explained below.

Figure 6:
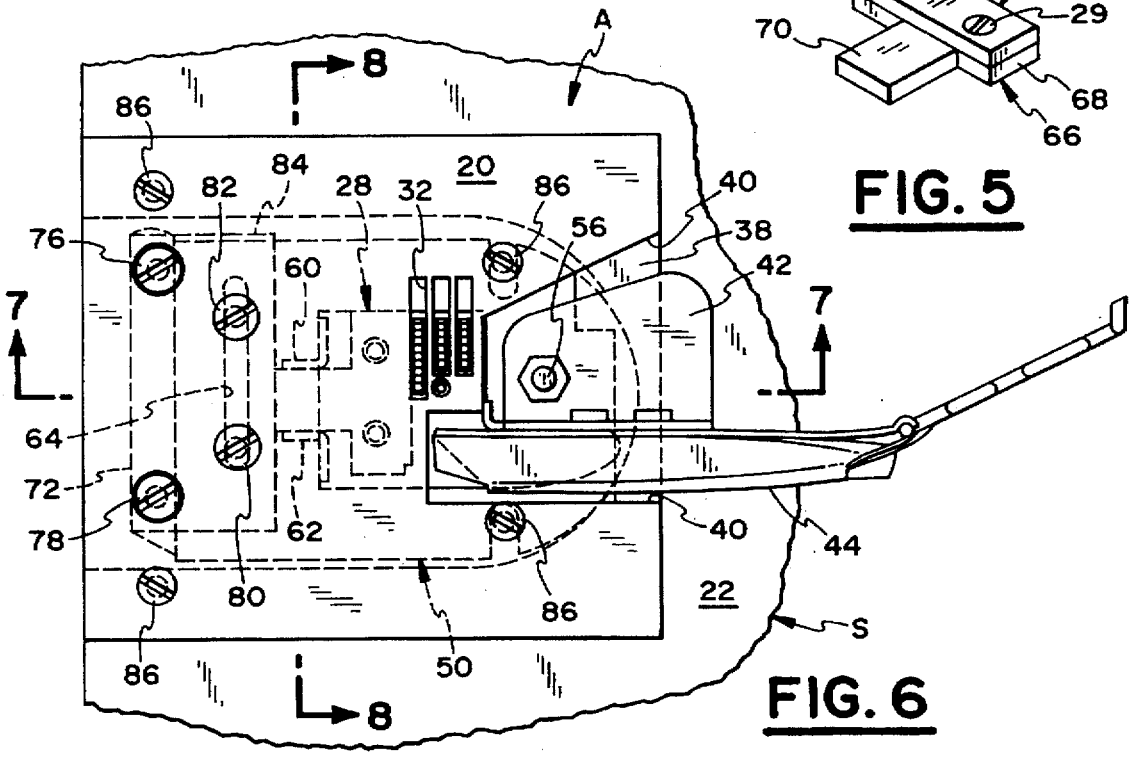
FIG. 6 is a top plan view of the device shown in FIG. 3 without portions of the needle plate broken away and showing the needle plate secured to the table of a sewing machine having portions broken away.

As best shown in FIGS. 4 and 6, the folder attachment A is secured to a sewing machine table 22 by anchoring screws 86 or other fasteners. The prime mover 26 of the sewing machine is affixed to the feeder connector 66 with screws 29 or other fasteners. Hem material (not shown) is fed within folder 44 in a manner as is known in the art with the folded material being continuously conveyed and aligned parallel to movement of the feeder 66.

It should be understood the sewing machine attachment as set forth above is susceptible to modifications without departing from the scope of the invention. For example, the reciprocating plate may be adapted to accommodate different feeder configurations. In the alternative, the underside of the base plate may be provided with integral track guides or mounting members that affix the reciprocation plate.

The operation of a sewing machine provided with the present invention described above will now be described.

Figure 8A:
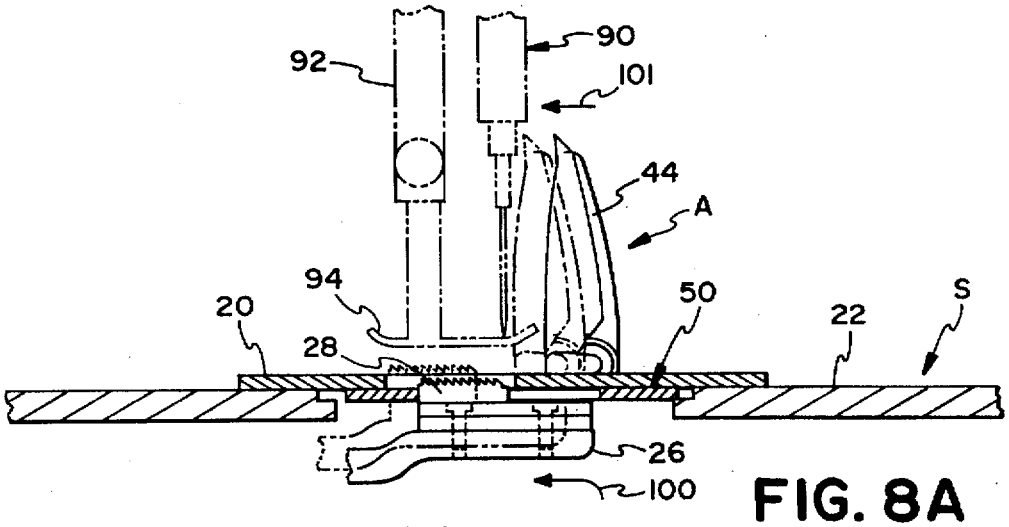
FIGS. 8A and 8B are side cross-sectional views of the present invention secured to a sewing machine table and showing the needle, presser foot, feeder and folder in both solid and phantom lines.
Figure 8B:
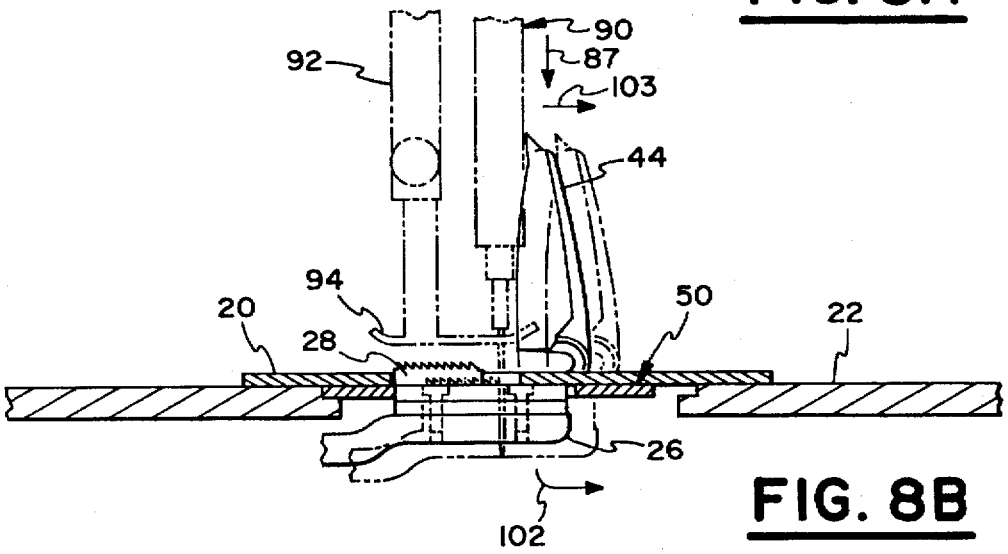

FIGS. 8A and 8B illustrate the present invention in conjunction with a sewing machine. The sewing machine S includes a reciprocating needle and needle bar 90 positioned directly over the base or needle plate 20 and vertically oriented over the feeder 28. In the known and conventional manner, the sewing machine includes a bed or table 22 to support the fabric workpiece (not shown). The fabric workpiece is advanced to a position underneath the needle by means of a reciprocating feeder 28 connected to a prime mover 26. A presser foot 94 including holder 92 is also provided and caused to move toward the needle plate 20 and the feeder 28. The needle 90 is provided with a substantially vertical reciprocating movement in the direction of arrow 87 (FIG. 8B) so that it may carry out stitching on a workpiece (not shown) in the region of the presser foot 94 and in combination with other known means within the art.

Figure 7:
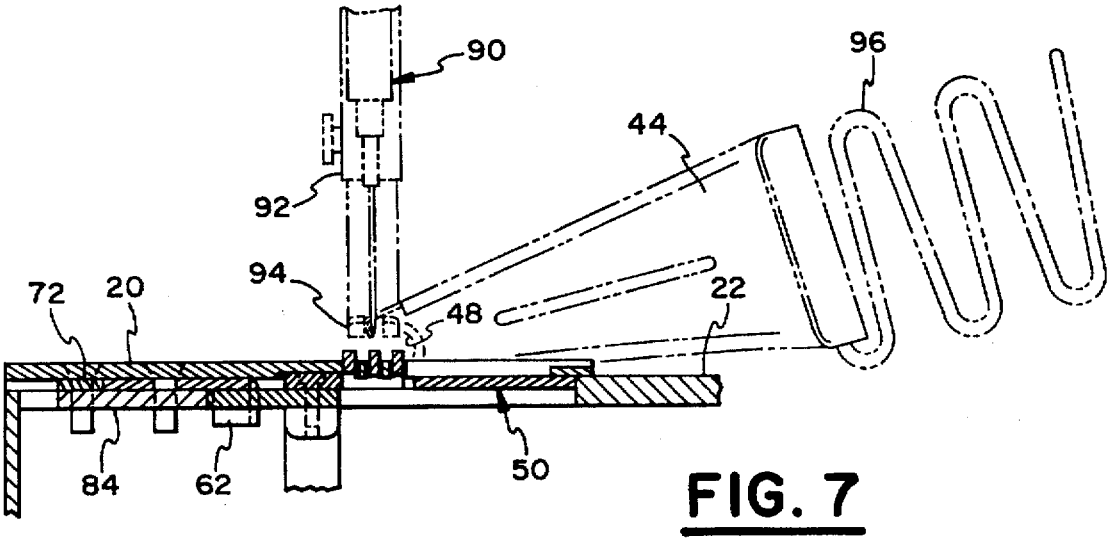
FIG. 7 is a side cross-sectional view taken along line 7—7 of FIG. 6 with portions of the sewing machine and prime mover shown broker away and with the folder, a needle and presser foot shown in phantom lines.

As shown in FIG. 7, the folder attachment 44 will receive a continuous length of fabric material (not shown) and cause it to be single or double folded prior to being sewn onto the edge of a fabric workpiece (not shown). The hem material is stored in the form of a roller (not shown) which is threaded through a feed portion 96 of folder attachment 44. The folder attachment itself is configured in a manner as to enable it to longitudinally fold the hem material passing through the folder attachment. The folded hem material exits the folder portion 48 in a position adjacent the feeder 28 thereby allowing the workpiece (not shown) to have an edge thereof inserted within the interior of the fold immediately prior to being stitched by the reciprocating needle 90.

Figure 9A:
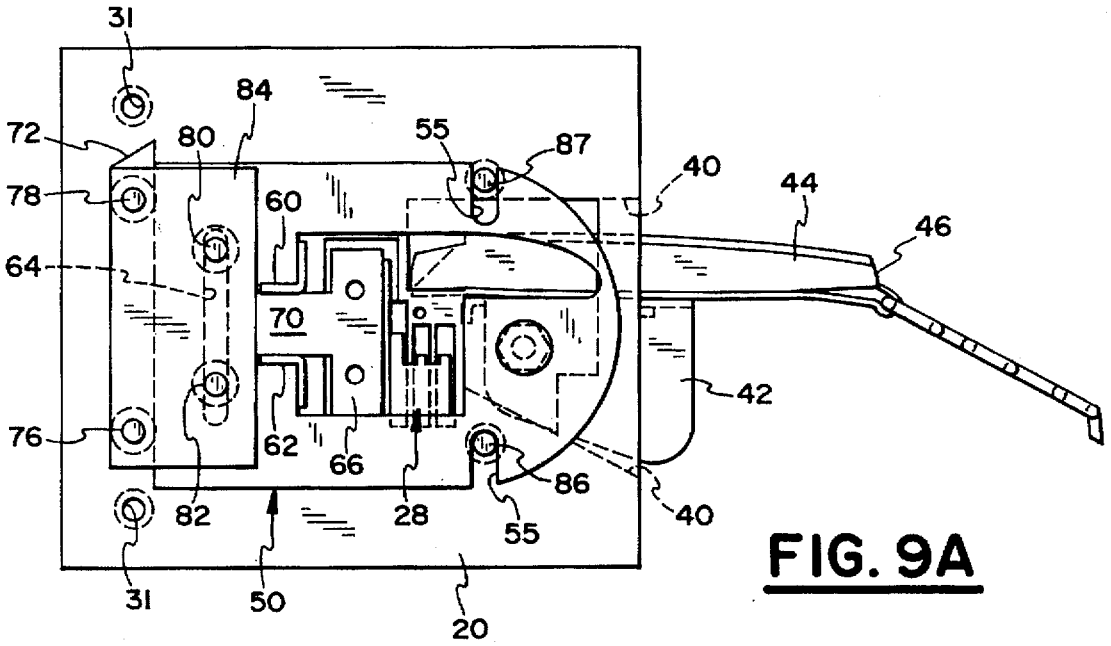
FIGS. 9A and 9B are bottom plan views of the device shown in FIG. 3 depicting the change in position of the reciprocation plate with movement of the feeder and including arrows to indicate direction of movement.
Figure 9B:
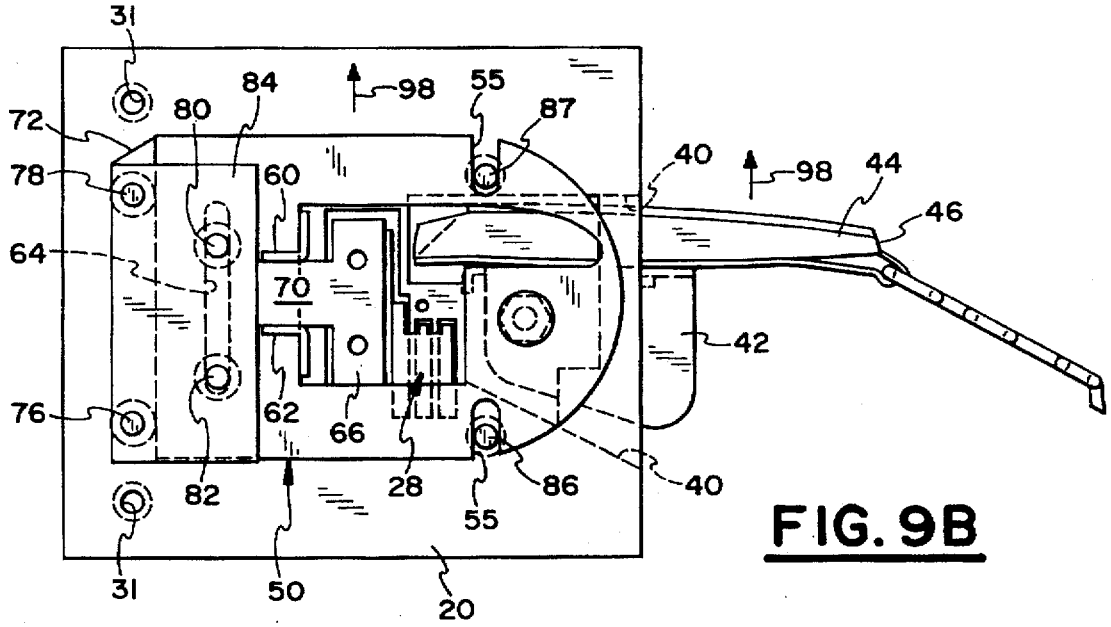

Details regarding movement of the feeder connector 66 and reciprocating plate during operation are best shown in FIGS. 9A and 9B. FIG. 9A illustrates the folder attachment 44 in a first position whereby the base member 42 of the folder 44 is resting against recessed abutment 40 of needle plate 20 and reciprocation plate 50 abuts screw or stop member 86 extending within plate slot 55. A screw or stop member 80 extends through track 64 at a first end thereof and also functions to restrict reciprocation plate 50 to the first position.

Upon commencement of the sewing operation, the prime mover 26 (not shown) for the feeder 28 will cause movement of the feeder connector 66 and extention 70. Because the extention 70 is positioned between plate flanges 60 and 62, it will cause reciprocation plate 50 to likewise move to a second position best shown in FIG. 9B and in a direction indicated by arrow 98. The extent of movement of reciprocating plate 50 is limited by a screw or stop member 87 positioned within slot 55 and screw or stop member 82 within track 64.

Thus, the folder attachment 44, which is pivotally connected to reciprocating plate 50, is caused to simultaneously reciprocate with feeder 28 as it cycles between the two positions set forth above. This is best shown in FIGS. 8A and 8B. In FIG. 8A, the prime mover 26 shifts in a direction as indicated by arrow 100 causing the feeder 28 to move to a raised position shown by phantom lines. Simultaneously, the folder attachment 44, due to its connection to reciprocation plate 50, likewise shifts to a position shown in phantom lines and in a direction shown by arrow 101. In FIG. 8B, the needle 90 cycles downwardly and descends through the fabric workpiece to cause a stitch to be sewn. The prime mover 26 moves in a direction indicated by arrow 102 causing the feeder to move to the lowered position shown in phantom lines. The folder attachment, by virtue of its linkage to the reciprocation plate 50, will then shift to a second position shown in phantom lines and in a direction shown by arrow 103.

It is therefore apparent that when the feeder 28 cycles to cause advancement of the fabric workpiece, the folder attachment 44 is likewise cause to reciprocate and advance the hem material in a similar manner. The result is a stiching operation whereby the workpiece and the hem material are simultaneously advanced into the stiching position. A uniform and evenly stitched hem line is formed. This is best shown in FIG. 10 whereby the workpiece 104 contains a uniformly stitched hem line 106 lacking the uneven edges of the PRIOR ART (FIG. 2).

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central feature hereinbefore set forth, and fall within the scope of the invention and of the limits of the appended claims.

I claim:

1. A sewing machine attachment for sewing a length of hem material onto an edge of a workpiece comprising:

a) a hem folder, said hem folder configured for folding a strip of hem material and aligning the folded hem material with a needle of a sewing machine to facilitate the sewing thereof onto an edge of a fabric workpiece; and b) a linkage mechanism connected to said hem folder for interconnecting said hem folder to a workpiece feeder of a sewing machine whereby movement of the workpiece feeder causes reciprocation of said hem folder and synchronous advancement of the hem material with the fabric workpiece.

2. A sewing machine attachment as in claim 1 and further including:

a) a needle plate base member having a top surface and a bottom surface, said base member operatively connected to a sewing machine and feeder for conveying a workpiece positioned thereon into lateral alignment with the needle.

3. A sewing machine attachment as in claim 2 and wherein:

a) said linkage mechanism including a feeder extension member, said extension member is positioned adjacent said base member bottom surface and configured for connection to the feeder, a reciprocating plate in sliding engagement with said base member bottom surface, said reciprocating plate is operatively connected to said extension member for reciprocating movement therewith following feeder movement during a sewing operation and a hem folder mount for mounting said hem folder to said reciprocating plate for movement therewith.

4. A sewing machine attachment as in claim 3 and wherein:

a) said extension member comprising a flange member projecting laterally from the feeder and in the same plane thereof.

5. A sewing machine attachment as in claim 4 and further including:

a) detent member, said detent member extends perpendicular from said reciprocation plate and about said flange member.

6. A sewing machine attachment as in claim 4 and further including:

a) stop device, said stop device configured for limiting the distance of travel of said reciprocating plate.

7. A sewing machine attachment as in claim 6 and wherein:

a) said stop device including at least one slot extending through said reciprocating plate and in parallel alignment to the direction of movement of the sewing machine feeder and a projecting member extending transverse therethrough from said base member.

8. A sewing machine attachment as in claim 3 and further including:

a) a track guide, said track guide operatively associated with said reciprocating plate to limit movement thereof along a fixed line.

9. A sewing machine attachment as in claim 8 and wherein:

a) said track guide comprising a plate member fixed to said base member bottom surface and in an abutting relation to at least one side edge of said reciprocating plate.

10. A sewing machine attachment as in claim 3 and wherein:

a) said mounting device comprising a pivot extending transverse through said base member and from said reciprocating plate to said hem folder.

11. An automatic sewing machine adapted for sewing a length of hem material onto an edge of a fabric workpiece comprising:

a) a reciprocating needle for stitching a workpiece;

b) a feeder guide including a reciprocating toothed member for conveying the workpiece into alignment with said reciprocating needle;

c) a hem folder, said hem folder configured for folding a strip of hem material and aligning the folded hem material with said needle to facilitate the sewing of the folded hem material onto the edge of the fabric workpiece; and d) a linkage mechanism connected to said hem folder and interconnecting said hem folder to said feeder guide whereby movement of said feeder guide will cause reciprocation of said hem folder and synchronous advancement of the hem material with the fabric workpiece.

12. A sewing machine as in claim 11 and further including:

a) a needle plate base member having a top surface and a bottom surface, said base member operatively connected to said feeder guide for conveying a workpiece positioned thereon into lateral alignment with said needle.

13. A sewing machine as in claim 12 and wherein:

a) said linkage mechanism including a toothed member extension, said extension is positioned adjacent said base member bottom surface and connected to said toothed member, a reciprocating plate in sliding engagement with said base member bottom surface, said reciprocating plate is operatively connected to said extension for reciprocating movement therewith following movement of said feeder guide during a sewing operation and, a hem folder mount for securing said hem folder to said reciprocating plate for movement therewith.

14. A sewing machine in claim 13 wherein:

a) said extension comprising a flange member projecting laterally of said toothed member and in the same plane thereof.

15. A sewing machine as in claim 14 and further including:

a) detent members, said detent members extend perpendicular from said reciprocating plate and about said flange member.

16. A sewing machine as in claim 14 and further including:

a) a stop limited, said stop limiter operatively connected to said reciprocation plate for limiting movement thereof.

17. A sewing machine as in claim 16 and wherein:

a) said stop limited including at least one slot extending through said reciprocating plate and aligned parallel to the direction of movement of said feeder guide and a projecting member extending transverse therethrough from said base member.

18. A sewing machine as in claim 13 and further including:

a) a track guide, said track guide operatively associated with said reciprocating plate for causing said reciprocating plate to move along a fixed line.

19. A sewing machine as in claim 18 and wherein:

a) said track guide comprising a plate member fixed to said base member bottom surface and in an abutting relation to at least one side edge of said reciprocating plate.

20. A sewing machine attachment for sewing a length of hem material onto an edge of a workpiece comprising:

a) a hem folder, said hem folder configured for folding a strip of hem material and aligning the folded hem material with a needle of a sewing machine to facilitate the sewing thereof onto an edge of a fabric workpiece;

b) a needle plate base member having a top surface and a bottom surface, said base member operatively connectable to a sewing machine and associated workpiece feeder, said workpiece feeder for conveying a workpiece positioned thereon into lateral alignment with the needle; and c) a sliding plate mechanism connected to said hem folder for interconnecting said hem folder to a workpiece feeder of a sewing machine, said sliding plate having a first end and a second end, said sliding plate first end connectable to a workpiece feeder of a sewing machine to provide reciprocation therewith and said sliding plate second end connected to said hem folder whereby operation of the workpiece feeder will cause reciprocal movement of said hem folder and synchronous advancement of the hem material with the fabric workpiece.

* * * * *